US005564598A

United States Patent [19]

Camm et al.

[11] Patent Number: 5,564,598

[45] Date of Patent: Oct. 15, 1996

[54] MULTIPLE COMPONENT DISPENSER CARTRIDGE FOR DISPENSING GUNS

[75] Inventors: James O. Camm, 51 Millewa Avenue, Chadstone, Victoria 3148; Stephen J. Camm, 11 Kaisman Square, Wantirna, Victoria 3152; John J. Camm, East Malvern, all of Australia

[73] Assignees: James Owen Camm; Stephen John Camm, both of Victoria, Australia

[21] Appl. No.: 520,397

[22] Filed: Aug. 29, 1995

Related U.S. Application Data

[62] Division of Ser. No. 182,058, Jan. 18, 1994, Pat. No. 5,540,356 which is a continuation of PCT/AU92/00287, Jun. 16, 1992.

[30] Foreign Application Priority Data

Jul. 15, 1991 [AU] Australia ..... PK7209

[51] Int. Cl.[6] ..... B67D 5/00

[52] U.S. Cl. ..... 222/80; 222/137

[58] Field of Search ..... 222/80, 95, 137

[56] References Cited

U.S. PATENT DOCUMENTS

| | | | |
|---|---|---|---|
| 3,675,821 | 7/1972 | Morane . | |
| 4,366,919 | 1/1983 | Anderson | 222/137 |
| 4,493,436 | 1/1985 | Brokaw | 222/80 |
| 4,690,306 | 9/1987 | Staheli | 222/137 X |
| 4,691,845 | 9/1987 | Schwartz | 222/95 X |
| 5,050,774 | 9/1991 | Camm et al. | 222/137 X |
| 5,209,376 | 5/1993 | Dirksing | 222/137 X |
| 5,330,074 | 7/1994 | Wirsig et al. | 222/95 X |
| 5,375,740 | 12/1994 | Umetsu et al. | 222/95 |

*Primary Examiner*—Gregory L. Hudson
*Attorney, Agent, or Firm*—Larson and Taylor

[57] ABSTRACT

A dispenser includes a first container (12) for containing a component C and a cavity (30) for receiving a separate cartridge (60). A first piston (34) is received in the container (12) and a second piston (78) is received in the cartridge (60). A blade (48) extends between the piston (34) and piston (78) for slicing the separate cartridge (60) as the pistons move so that the component C and a second component C1 in the separate cartridge (60) are expelled from the dispenser. A valve arrangement (100) can be coupled to an outlet (18) for the dispenser in order to dispense the components C and C1 and a flexible sleeve (50) may be arranged in the container (12) between a sidewall of the container (12) and the piston (34) for sealing any space between the piston (34) and the sidewall of the container (12).

8 Claims, 12 Drawing Sheets

228
206
226

228
226
204
202
206
225
200

C
C1
208
220
222
224
224
228
225
226
200

A
222
208
224
224
242
240
244

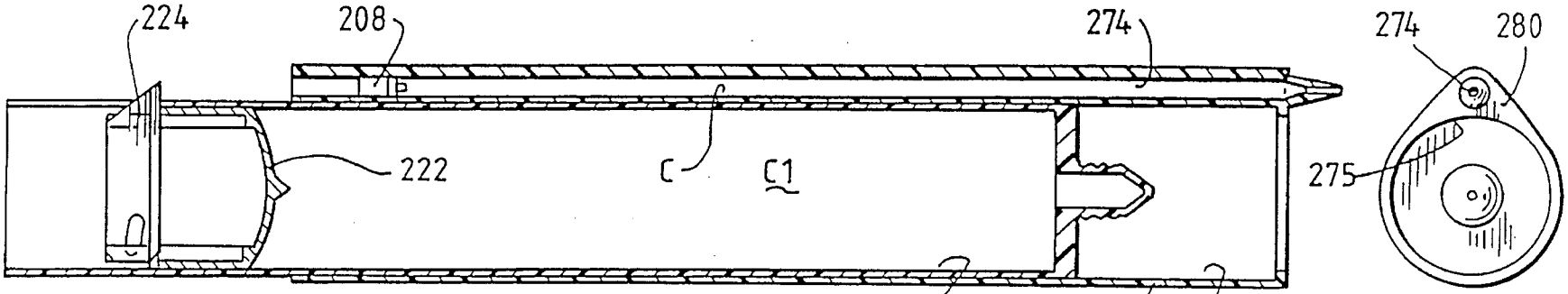
FIG. 9A
FIG. 9.
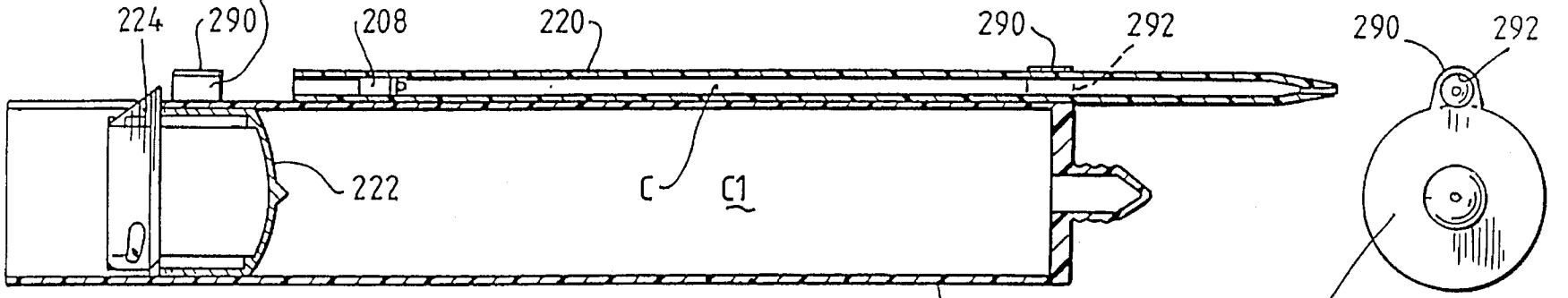
FIG. 10A
FIG. 10.

MULTIPLE COMPONENT DISPENSER CARTRIDGE FOR DISPENSING GUNS

This is a divisional application of application Ser. No. 08/182,058 filed Jan. 18, 1994, allowed on Jan. 30, 1996, now U.S. Pat. No. 5,540,356 which is a 371 continuation of International Application No. PCT/AU92/00287 filed on Jun. 16, 1992 (and amended on Jan. 26, 1993, Feb. 3, 1993 and Mar. 25, 1993).

This invention relates to a dispenser for dispensing two or more components which can then be mixed and has particular application to dispensing two-part polymers which remain inert before mixing, but react to form a solid upon mixing. One specific example of the invention relates to the mixing of a putty and hardener for use in car body work wherein the putty and hardener are mixed in a ratio of 50:1.

Conventional methods of mixing the putty and hardener comprise dispensing the putty from a 20 kg drum and manually adding a certain amount of hardener to the putty in order to form the solid material. When mixing putty with hardener for use in body work, it is important that the ratio of 50:1 be strictly adhered to and therefore this method involves considerable manual activity to ensure that the correct amount of each component is obtained and mixed. In view of this an automatic method of dispensing the two components was developed which comprises movable pistons which are interconnected by linkages.

In view of the nature of the materials contained in dispensers of the above type, it is desirable to transport the two components separately from one another and possibly at different times. It would therefore be desirable to provide a dispenser which is able to allow transportation of the two components separately from one another and wherein the two components can be placed together for dispensing and then mixing.

The invention provides a dispenser comprising:

a container for containing a first component;

a tube which forms a cavity for receiving a separate cartridge which contains a second component;

an opening in the tube for allowing the first component to pass from the container and out of the dispenser after the separate cartridge is inserted into the cavity;

dispensing means for forcing the first component from the container and the second component from the cartridge so that the first component exits the dispenser through the opening in the tube and the second component exits from the separate cartridge; and wherein the first component can be stored and transported in the container and the separate cartridge stored and transported separately and inserted into the cavity when it is desired to dispense the first and second components.

Preferably the tube is screw threaded to said container to define the cavity, said tube being substantially of uniform cross-section throughout its length, said opening being in a lower side wall of the tube.

In a further embodiment the tube includes a lower enlarged diameter section which is screw threaded to said container, said opening being provided in the enlarged diameter portion of the tube and extending substantially parallel to the longitudinal axis of the tube.

Preferably the enlarged diameter portion of the tube is eccentrically arranged with respect to the remainder of the tube. However, in other embodiments the remainder of the tube could be concentrically arranged with respect to the enlarged diameter portion of the tube.

Preferably the dispensing means comprises pistons and a cutting means is provided to cut both the tube and the separate cartridge to enable movement of the pistons.

Preferably the cutting means is a blade fixed to the first piston and extending across said cavity and therefore across said separate cartridge when the separate cartridge is located in the cavity so as to slice the separate cartridge and push the second piston when the first piston is moved.

The invention also provides a cartridge for a dispenser which includes a first container for containing a first component which is to be dispensed for mixing with a second component contained in the cartridge, said cartridge comprising:

a cartridge body for containing the second component;

an outlet member coupled to said cartridge and having a first outlet for communicating with the container when the cartridge is engaged with the dispenser and a second outlet in communication with the cartridge;

such that the first component can be dispensed from the container through the first outlet in the outlet member and the second component can be dispensed through the second outlet in the outlet member so that the first and second components can be dispensed simultaneously but separately from the outlet member.

The invention also provides a dispenser comprising:

a first container for containing a first component;

a cavity in the first container;

a separate cartridge for containing a second component for location in the cavity;

a rod arranged in the said separate cartridge and extending out of said separate cartridge so that said rod can be coupled to the first container to secure the separate cartridge in the cavity; and dispensing means for forcing the first and second components from the container and the separate cartridge when the separate cartridge is located in the cavity.

The invention also provides a dispenser comprising:

a container for containing a first component;

an outlet in the container;

a piston in the container for movement to dispense the first component from the container through the outlet;

a cavity;

a separate cartridge for insertion in the cavity, said separate cartridge containing a second component;

a piston for location in the separate cartridge for movement to dispense the second component from the cartridge;

abutment members coupled to one of said first piston or the second piston for engaging the other of the first piston or second piston when the separate cartridge is arranged within the cavity and said one of the first piston or second piston is moved to thereby cause movement of the other piston so that the first and second components are dispensed from the container and the cartridge.

The invention also provides a dispenser comprising:

a first container having an outer container wall of a predetermined profile;

a piston arranged in the first container for movement in the first container to dispense a component contained in the first container;

a separate cartridge having a first wall portion and a second wall portion, the first wall portion having a contour which matches the predetermined profile of the first container so that the cartridge can be engaged with the first container with the first wall of the cartridge contacting the wall of the first container, and the second wall of the cartridge forming a smooth transition to the remainder of the predetermined profile of the first container not in engagement with the first wall of the cartridge.

The invention also provides a cartridge for receipt in a cavity of a dispenser, said cartridge comprising:

a housing for containing a component;

an outlet in the housing for enabling the component to be expelled from the housing; and a piston arranged in the housing for movement relative to the housing to expel the component from the housing through the opening.

A second aspect of the invention is concerned with dispensing components of high viscosity and with preventing the first component in the container from moving past the first piston when the first piston is moved in the container. In large containers such as 20 liter containers normal manufacturing tolerances can make it difficult for the piston located in the container to be a perfect sealing fit within the container. Thus, as the piston is moved in the container it is possible for the component in the container to move past the piston between a side wall of the piston and the side wall of the container. This can cause the piston to stick. Furthermore, if material is lodged between the piston and the side wall of the container it can dry or harden and piston can flex considerably before moving when next depressed to expel more material. In the worst case the piston can fracture, thus destroying the ability to dispense. If the system is a dual dispense system even minor flexing of the piston should be avoided because the ratio of the dispensed materials will change.

A second object of the invention is to overcome this problem.

A second aspect of the invention may be said to reside in a dispenser comprising:

a container for containing a first component, said container having a side wall;

a piston arranged for movement within said container for forcing said first component out of said container, said piston having a peripheral portion; and a flexible sleeve arranged within said container between the side wall of said container and said component in said container, said flexible sleeve having a portion arranged between said first component and said piston such that as said piston moves said resilient sleeve forms a seal between said first component and any space between the peripheral portion of said piston and the side wall of said container for preventing the first component from entering said space.

Preferably said container includes a cavity for receiving a cartridge containing a second component for mixing with the first component.

Preferably the dispenser includes blade means coupled to said piston for cutting through said cartridge when said cartridge is located in said cavity and which abuts a second piston within said cartridge for moving said second piston with said first piston to force the second component out of said cartridge.

A third aspect of the invention relates to a cartridge for use with the dispenser referred to above.

The third aspect of the invention may be said to reside in a cartridge for receipt in a cavity of a dispenser, said cartridge comprising:

a housing for containing a component;

an outlet in said housing for enabling the component to be expelled from the housing; and a piston arranged in said housing for movement relative to said housing to expel said component from the housing through said opening.

Preferably said cartridge has a bottom plate, a reinforcing rod coupled to said bottom plate, said reinforcing rod extending through said housing to a position outwardly of said housing and wherein said bottom plate has engaging means for engaging a portion of the dispenser and said rod has coupling means for enabling the rod to be coupled to another portion of the dispenser so that the said portions of the dispenser are reinforced by said reinforcing rod to prevent flexing of those portions of the dispenser.

Preferably said cartridge includes a valve arrangement having a first valve communicating with said outlet and a second valve which communicates to the exterior of said cartridge such than another component to be mixed with the component in the cartridge can pass through the second valve and the component in the cartridge can Bass through the first valve.

Preferably the valve arrangement includes hand operated closure means which upon operation can selectively open or close both of said valves substantially simultaneously.

A preferred embodiment of the invention will be described, by way of example, with reference to the accompanying drawings in which:

FIGS. 9 to 14 show still further embodiments of the invention; and

Figure 1:
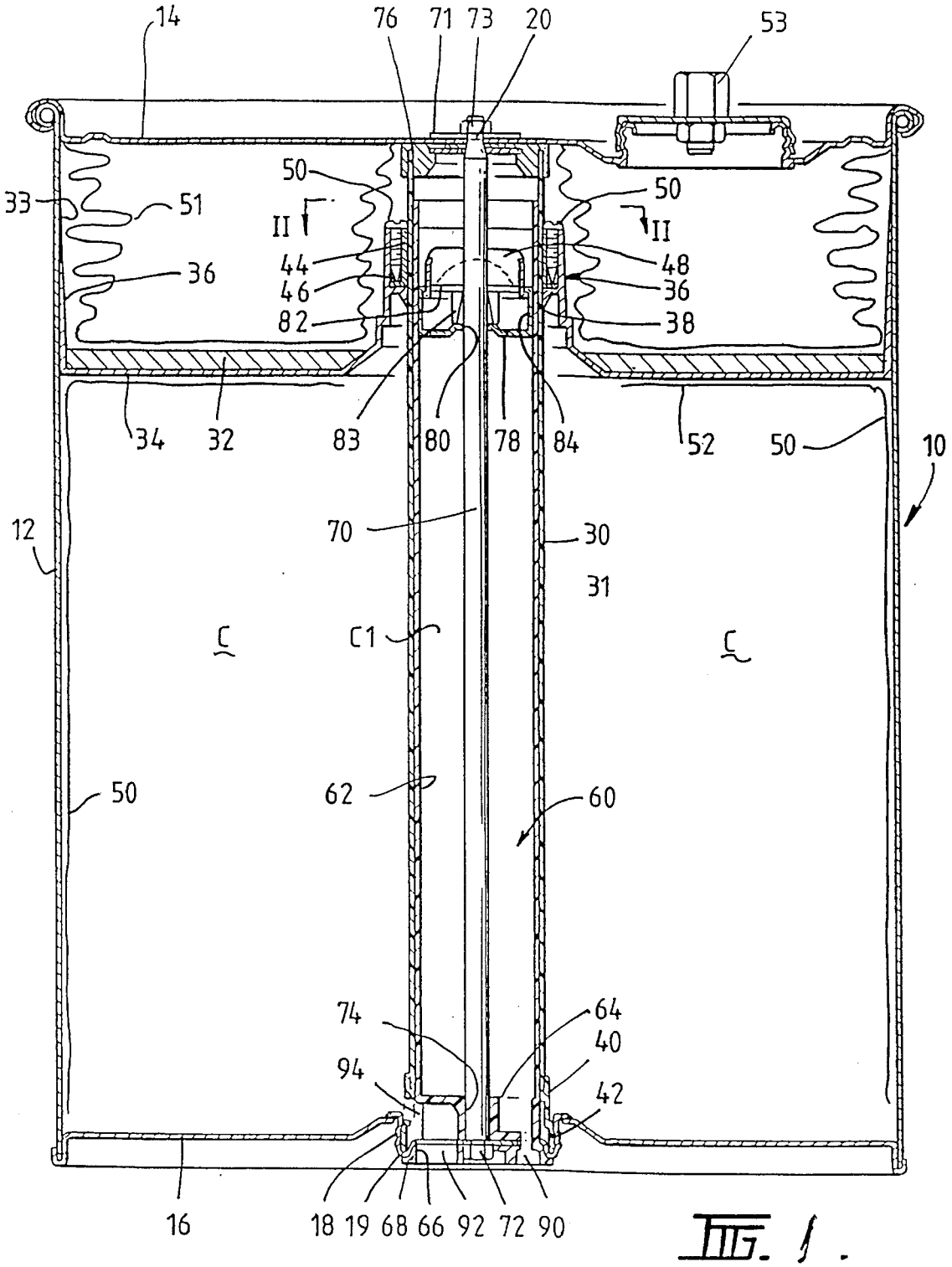
FIG. 1 is a cross-sectional view through a dispenser embodying the invention.

With reference to FIG. 1 the dispenser comprises a container 12 which is in the form of a drum which may preferably be 20 liters in capacity. The drum 12 has a removable lid 14 and a base 16.

The base 16 is provided with a conventional screw threaded outlet neck 18 of the type which normally receives threaded cap for closing a drum. The lid 14 has a hole 20, the purpose of which will be described hereinafter. The container 12 is provided with a cylindrical internal tube 30 which defines a cavity 31 which in the preferred embodiment is arranged centrally in the container 12. However, in other embodiments the tube 30 could be arranged anywhere in the container.12 or for that matter outside the container 12 on a side wall of the container 12 and secured relative to the container 12 by any suitable fasteners or method. The tube 30 is formed from plastics material or any other material which can be cut by a blade.

A first piston 32 is arranged within the drum and has a base 34 and an upstanding side wall 36 which form a general dish shape. The piston 32 is provided with a blade retainer 36 and a central opening 38 for receiving the tube 30.

The tube 30 passes through the opening 38 and has a base portion 40 which is provided with a downwardly extending flange 42 having a screw thread which screws onto the internal portion of the screw thread 18 to secure the tube 30 in place within the container.

In order to fill the container 12 with a first component C, the piston 32 is removed from the container 12 after removing lid 14. A flexible sleeve 50 of any suitable material such as paper, thin plastic sheet or the like is located within the container 12. With the tube 30 in place the component C is then supplied to the container 12 so that it is surrounded by the sleeve 50. The sleeve 50 includes a top portion 52 which is then folded over the upper surface of the component C.

The piston 32 may then be located in place with the tube 30 being received in the opening 38 and with the side wall 36 abutting the internal surface of wall 33 of container 12. As is clearly seen in FIG. 1, the upper portion 52 of the sleeve 50 forms a barrier between the component C and the side wall 36 of the piston 32 and the portion of the wall 33 of the container 12 which it engages.

Blade retainer 36 generally comprises blocks 44 which have a pair of slots 46 for receiving two blades 48. The blades 48 are held in place by screws 50 which are screwed into the blocks 44 so the head of the screws 50 overlap the blades 48 to secure then in the slots 46.

A cartridge 60 which generally comprises a cylindrical tube having a cylindrical wall 62 is provided for insertion into the cavity defined by the tube 30. The cartridge 60 is formed from plastics material or other material which can be cut by the blades 48. The cartridge has a base 64 which forms an outlet member and which includes a bottom plate 66 having a flange portion 68 which engages on the end 19 of the screw threaded neck 18. A reinforcing rod 70 is arranged within the cartridge 60 and is joined to the plate 66 by a nut 72 which engages on a screw threaded portion of the rod 70 passing through the plate 66. The rod 70 is also held within a sleeve portion 74 of the base 64 so as to be securely retained within the cartridge 60, The rod 70 extends all the way through the cartridge 60 and out through the top 76 of the cartridge 60, The cartridge 60 is provided with a second piston 78 which has a central hole 80 for accommodating the rod 70. A washer 82 having a pair of upturned sides 84 sits on the piston 78 and also has an opening (not shown) for accommodating the rod 70.

A second component C1 is contained within the cartridge 60 and the second piston 78 sits on the top of the component C1. The cartridge 60 is located in the cavity defined by the tube 30 by inserting it from the bottom so that the flange 68 abuts the end 19 of the screw threaded neck 18. The rod 70 passes through opening 20 in the lid 14 and is secured to the lid 14 by a washer 71 and a nut 73 which is received on a screw threaded end of the rod 70. A guide 83 is fitted to the blades 48 for guiding the rod 70 between the blades 48 when the cartridge is inserted into the cavity 31.

Figure 2:
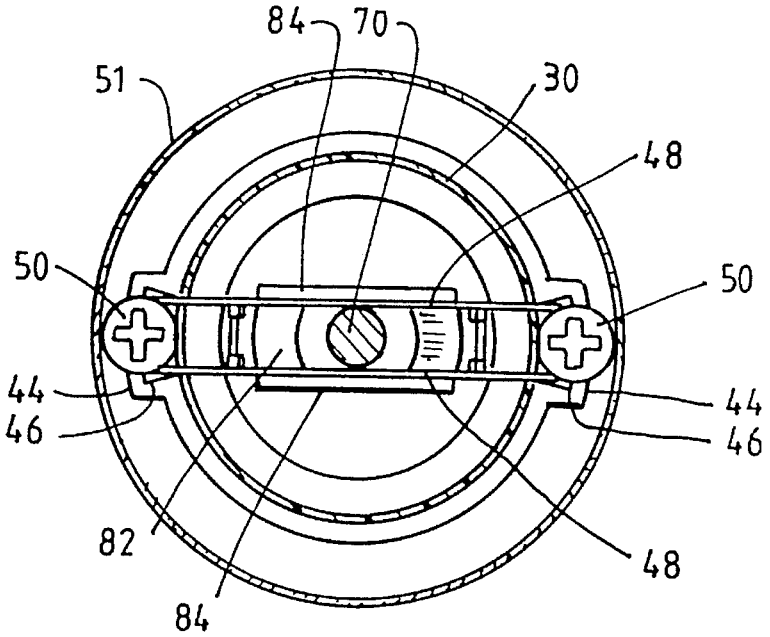
FIG. 2 is a view along the line II—II of FIG. 1.

As is best seen in FIG. 2, the rod 70 passes between the two blades 48 and the washer 82 is arranged such that the upturned sides 84 are on the other side of the blades 48 so that the blades 48 are sandwiched between the rod 70 and the upturned sides 84 of the washer 82.

The rod 70 therefore provides a retaining mechanism for retaining the separate cartridge 60 in the cavity formed by the tube 30 as well as holding the base and lid together and preventing them from bowing outwardly.

In the position shown in FIG. 1, the piston 32 is shown in a position where the blades 48 have already commenced to cut the tube 30 and the cylindrical wall 62 of the cartridge 60. Depending upon the amount of the component C in the container and the height of the tube 30 and cartridge 60, cutting of the tube 30 may commence upon assembly of the piston 32 in the container 12 and cutting of the cartridge 60 may commence when the cartridge is pushed into the cavity.

An inflatable air bag 51 is arranged about the tube 30 and generally within the first piston 32 for moving the first piston 32 within the container 12. In order to achieve this, air is supplied to the bag 51 via inlet 53 so that the bag expands to thereby force the piston 32 downwardly. Movement of the piston 32 downwardly will concurrently move the second piston 78 downwardly by virtue of engagement of the second piston 78 with the blades 48. Thus, since the blades 48 are secured to the piston 32 and since the blades 48 push on the second piston 78 via the washer 84 movement of the first piston 32 will cause corresponding movement of the second piston 78 within the cavity 60 with the blades 48 cutting through the tube 30 and the cylindrical wall 62 of the cavity 60 as the piston 32, blades 48 and second piston 78 move.

Movement of the first piston 32 and second piston 78 forces the components C and C1 out of the container 12 and cartridge 60 through an opening 90 in the base or outlet member 64 of the cartridge which communicates with the interior of the cartridge 60, and through a passage 92 in the base or outlet member 64 which passes through the base 64 and communicates with the exterior of the cartridge 60. The passage 92 is in registry with an opening 94 in the tube 30. Thus, component C can pass through the opening 94, through the passage 92 and outwardly of the dispenser and the component C1 can pass through the opening 90 outwardly of the dispenser.

Figure 2A:
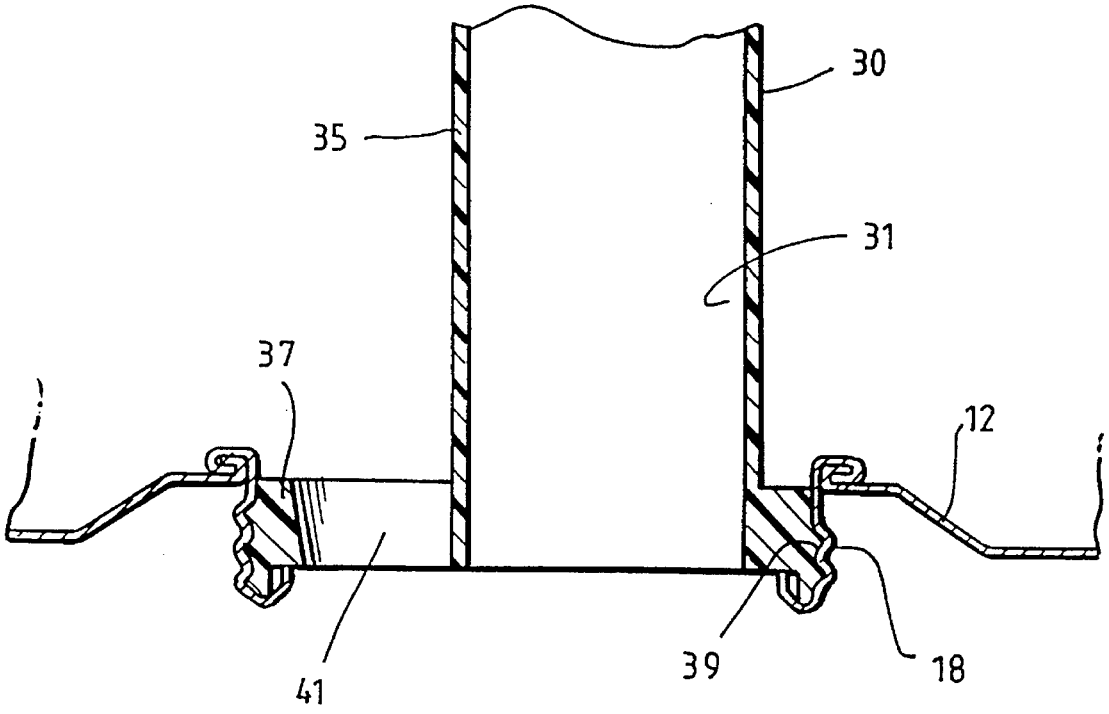
FIG. 2A is a view of an alternative embodiment of the invention.

FIG. 2A shows a second arrangement of the invention in which like reference numerals designate like parts to that described with reference to FIGS. 1 and 2. In this arrangement the tube 30 has an upper elongate narrow portion 35 and an enlarged diameter lower portion 37. The upper portion 35 is shown arranged eccentrically with respect to the enlarged diameter portion 37 but in other embodiments the upper portion of the tube 35 could be concentric with the enlarged diameter portion 37.

The container 12 is provided with a screw threaded neck 18 which is of relatively large diameter and the enlarged diameter portion 37 of the tube 30 is also provided with screw threads 39. The screw threads 39 are screwed into the screw threaded neck 18 so as to locate the tube 30 within the container 12.

The enlarged diameter portion 37 has an opening 41 in the form of a passage or the like which extends generally parallel to the longitudinal axis of the tube 30 and which communicates with the container 12.

As in the embodiment of FIG. 1 the cavity 31 defined by the tube 30 receives a separate cartridge 60 similar to that in FIG. 1. When the pistons move to dispense material from the cartridge 60 and the container 12 the component C1 is dispensed from the cartridge 60 in the same manner as described with reference to FIG. 1. The component C in the container 12 is dispensed through the passage 41 in the enlarged diameter portion 37 of tube 30.

In order to dispense the component C and C1 it is preferred that a valve arrangement be provided. In one embodiment of the invention the valve arrangement is a separate arrangement which is engaged with the container 12 and in a further embodiment the valve arrangement may be incorporated into the base 64 of the cartridge 60.

Figure 3:
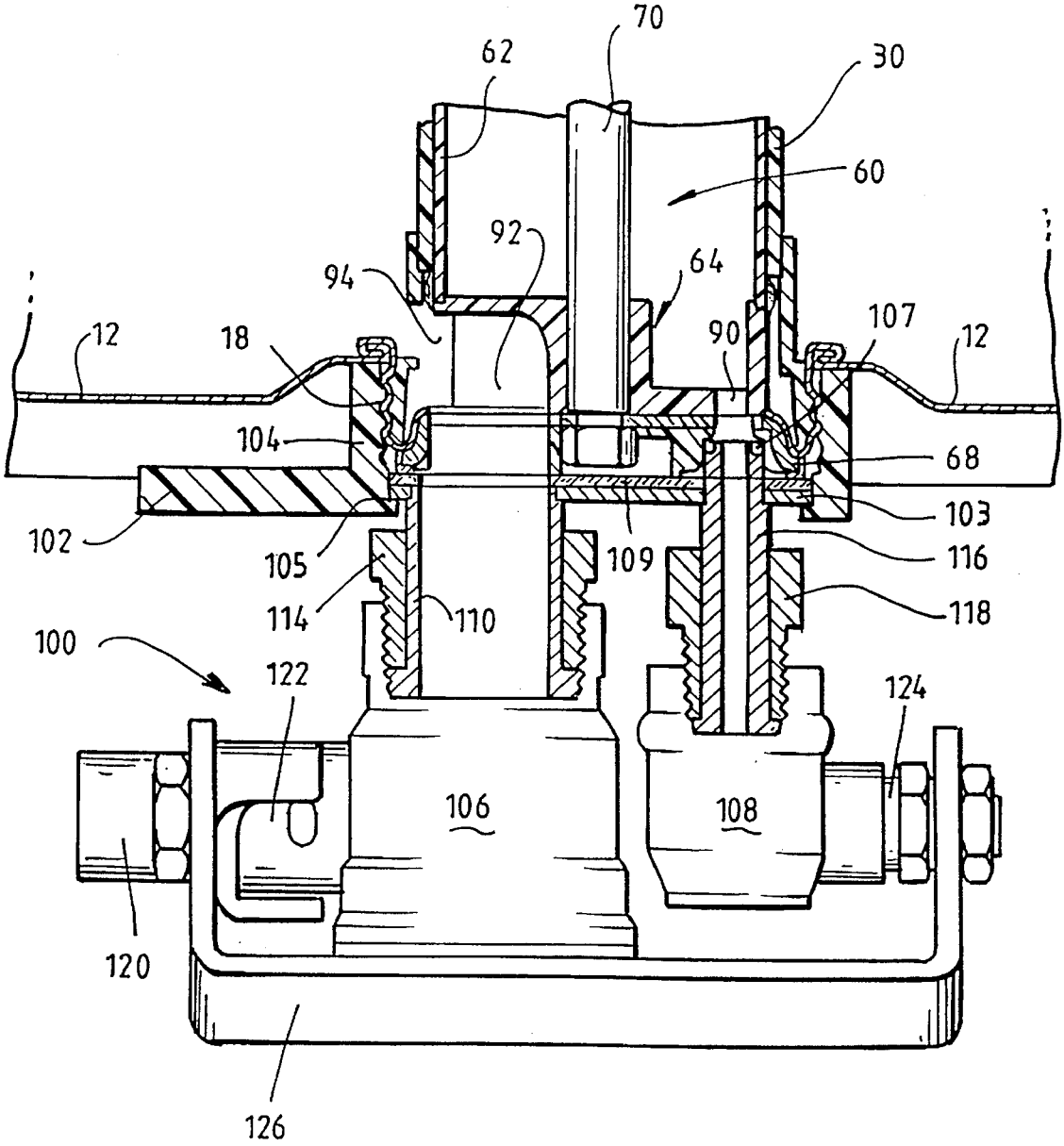
FIG. 3 is an enlarged view having a valve arrangement used with the preferred embodiment of the invention.

The first embodiment of the invention wherein the valve arrangement is separate to the cartridge 60 and is engaged with the container 12 is shown in FIG. 3.

As shown in FIG. 3 the valve arrangement 100 has a screw threaded cap portion 104 which is adapted to be screw threaded on the outside of the screw threaded neck 18 to thereby secure the valve arrangement 100 to the container 12. The valve arrangement 100 has a plate 103 which sits on step 105. The body 102 is screw threaded onto neck 18 so that the plate 103 is pulled upwardly against the base 64. A seal 109 is arranged between the plate 103 and the flange 68 so that the valve arrangement 100 seals when the body 102 screws up onto neck 18. Stems 110 and 116 are welded to the plate 103 and are screw threaded. The stems 110 and 116 support first and second valve elements 106 and 108. Nuts 114 and 118 are provided for securing the valve elements 106 and 108 in screw threaded manner on the stems 110 and 116. The stem 110 is flush with the plate 103 and in registry with opening 92 and the stem 116 passes through the plate 103 to be received in opening 90. A seal 107 is between stem 116 and opening 90 to prevent the components C and C1 from mixing in the valve arrangement 100.

A valve handle 120 is provided for operating the valves 106 and 108. The valve 106 is provided with a shaft 122 and the valve element 108 is provided with a shaft 124. Handle 120 has an interconnecting link 126 which is coupled to both of the shafts 122 and 124. The link 126 is also coupled to the handle 120. When the handle 120 is moved the link 126 is moved to thereby rotate the shafts 122 and 124 to selectively open both of the valve elements 106 and 108.

Thus, when the air bag 51 within the container 12 is operated to move the pistons 32 and 78, the handle 120 need only be operated to open the valves 106 and 108 so that the components C and C1 are dispensed through the valves 106 and 108 respectively in a predetermined desired ratio which is defined by the relative sizes of the container 12 and the cartridge 60 and the amount of movement of the pistons 32 and 78. Since the pistons 32 and 78 can only move together by virtue of abutment of the blade 48 on the second piston 78 via the washer 82 the exact predetermined ration of the component C and C1 which are defined by the size of the container 12 the size of the cartridge 60 and the openings 92 and 90 is delivered for mixing outside of the container 12.

In this embodiment of the invention the valve arrangement 100 and more particularly cap portion 104 may be used as the retaining means to retain the separate cartridge 60 in the cavity 30. In this embodiment the rod 70 may be omitted from the cartridge 60 completely and the cartridge 60 can simply be retained in the cavity formed by the tube 30 by locating the separate cartridge 60 in the cavity and then screw threading the cap 104 onto the neck 18 so that the valves 106 and 108 and plate 103 together with the screw thread engagement between the cap 104 and the neck 18 retains the cartridge in the cavity formed by the tube 30 during use of the dispenser. Thus, in this embodiment the retention of the separate cartridge in the cavity is by means of a screw threaded fixture which fixes onto the neck 18 and retains the separate cartridge 60 in the cavity formed by the tube 30.

In order to seal the neck 18 prior to arrangement of the valve arrangement 100 thereon, a cap (not shown in FIG. 3 but designated with reference numeral 150 in FIG. 4) may be screw threaded onto the neck 18 for transportation and storage of the container 12. After the cap is removed and the cartridge 60 is inserted into cavity 31 the valve arrangement 100 is screwed onto the neck 18 as described above.

Figure 4:
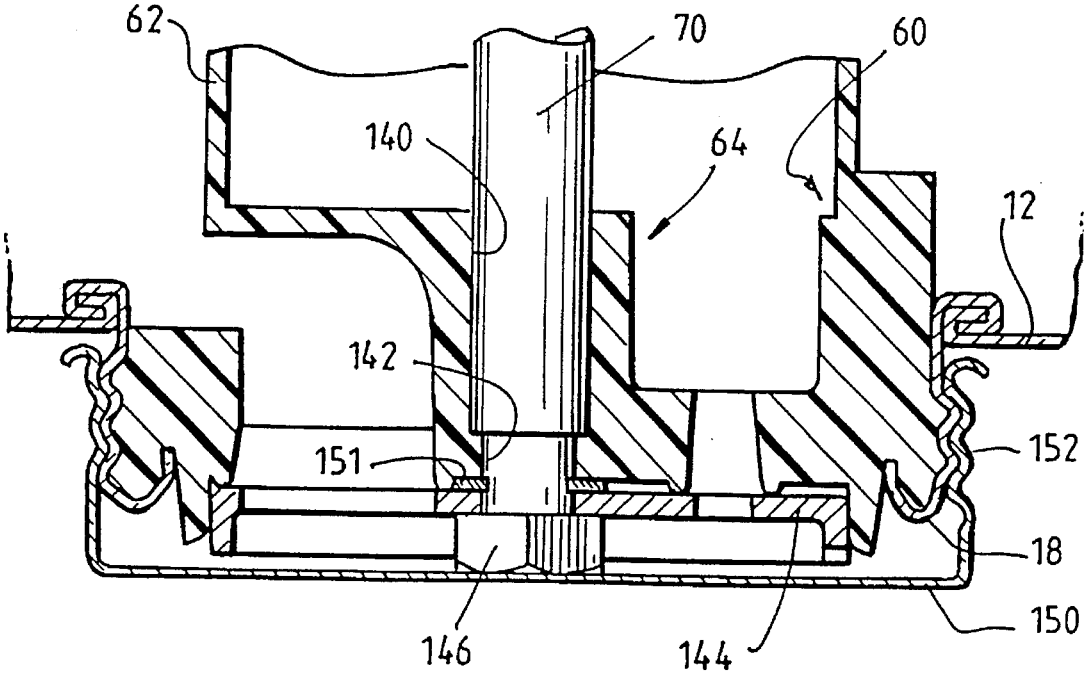
FIG. 4 is a cross-sectional view of a valve arrangement according to a second embodiment of the invention.
Figure 4A:
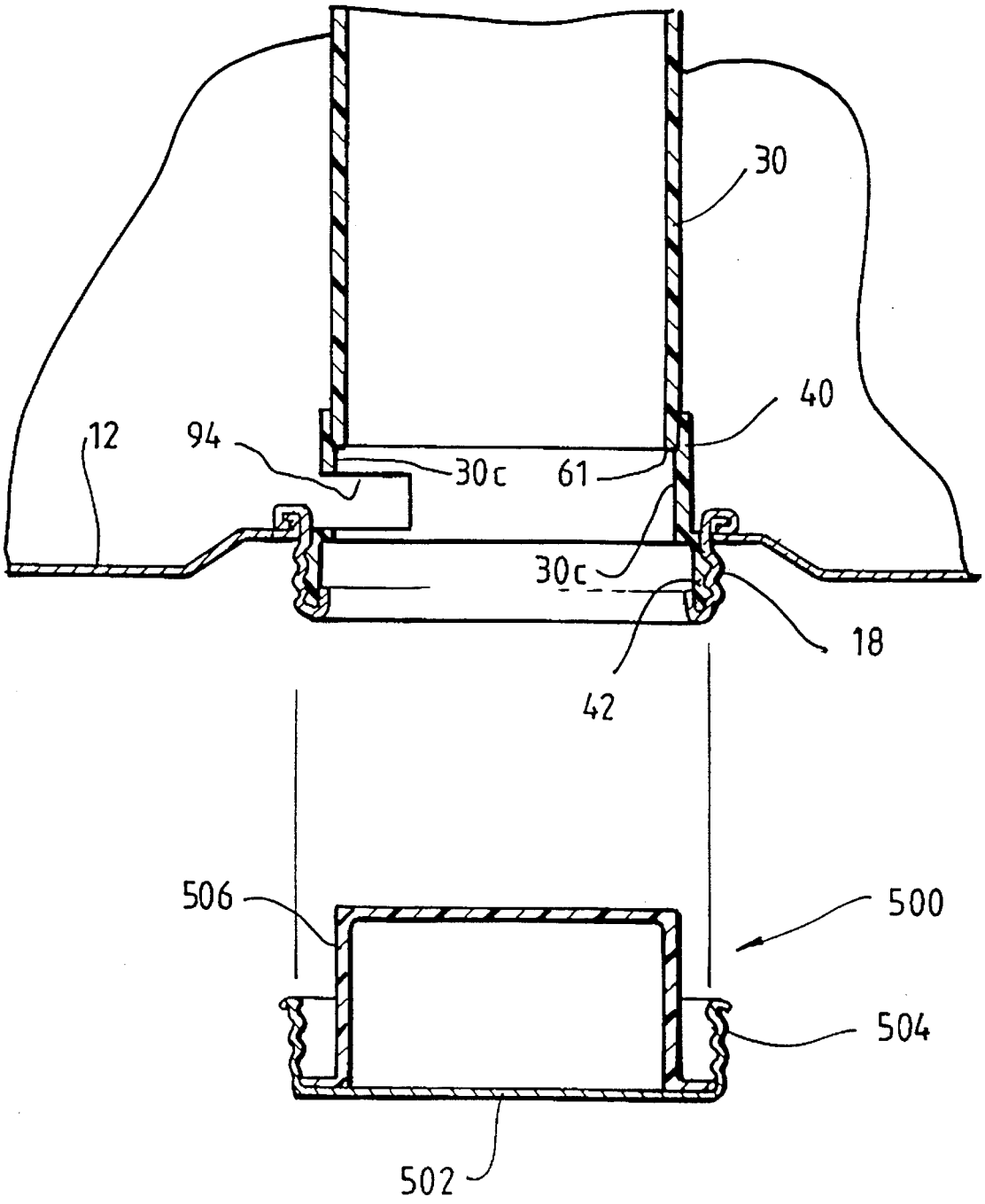
FIG. 4A, shows an alternative sealing system.

In FIG. 4A a separate closure is shown which may be used to close the dispenser before the separate cartridge 60 is inserted into the tube 30 and when the first component C is loaded into the container 12. In this embodiment like reference numerals indicate like parts to those described in the earlier embodiment.

In this embodiment the tube 30 has a base portion 40 which is provided with a downward extending flange 42 having a screw thread and further includes a plurality of holes or cutaway sections 94. The tube 30 can be screw thread into the neck 18 or snap fitted on the internal threads of the neck 18 to securely hold the tube 30 in place. A cap 500 is shown which has a base 502 and an upstanding screw threaded skirt 504. A sleeve 506 extends upwardly from the base 502 past the end of the screw threaded skirt 504. In order to seal the dispenser the cap 500 is screw threaded onto the neck 18 so that the sleeve 506 is received in the tube 30 with the sleeve 506 abutting wall portions 30C of the tube 30 so that the holes 94 are effectively covered and sealed when the skirt 504 is screw threaded onto the neck 18 or pushes onto a step 61 in tube 30. The dispenser including the component C can therefore be transported without fear of the component C leaking into the cavity. When it is desired to insert the separate cartridge 60 the cap 500 is simply unscrewed with the dispenser in an inverted position and a cartridge can then be inserted into the cavity formed by the tube 30 and retained in place either by the rod 70 or the valve arrangement 100 as previously described.

Figure 5:
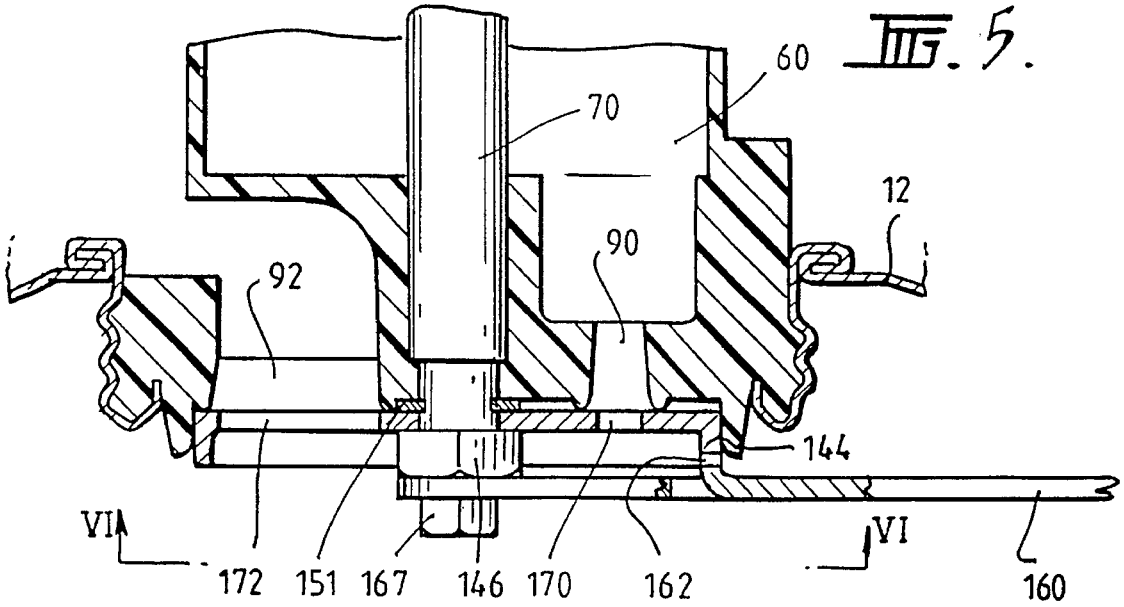
FIG. 5 is a view similar to FIG. 4 showing a tool in place for opening and closing the valve arrangement.
Figure 6:
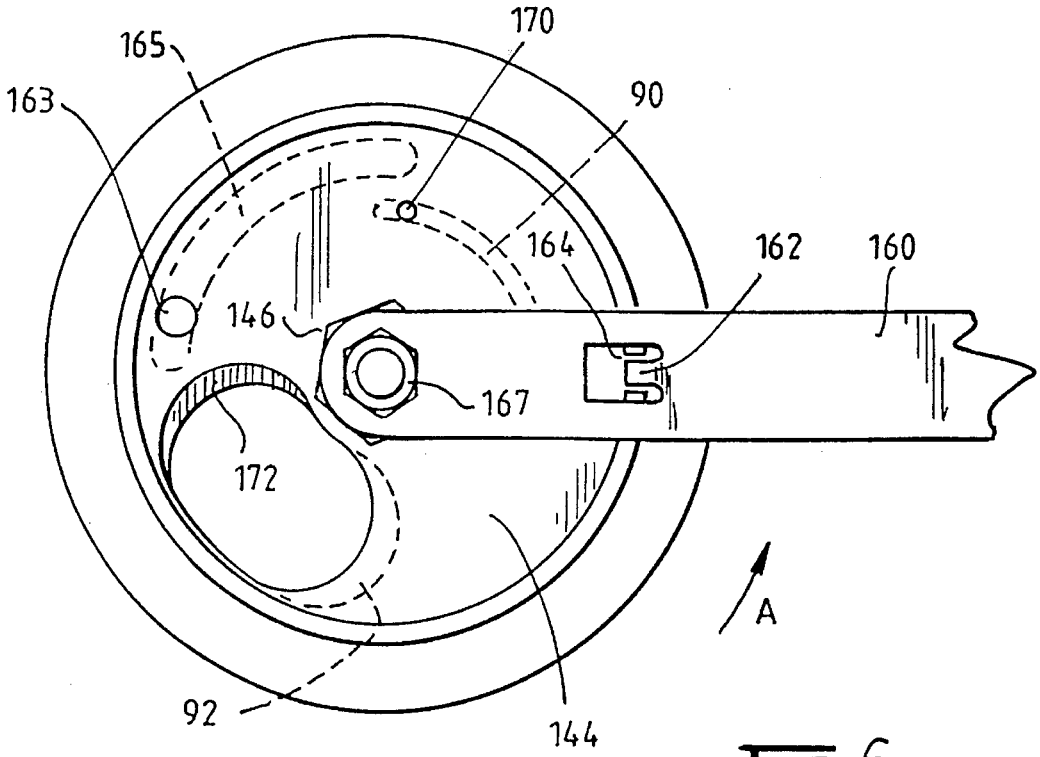
FIG. 6 is view along the line VI—VI of FIG. 5.

FIGS. 4, 5 and 6 show a second embodiment in which the valve arrangement is formed within the base 64 Of the cartridge 60. In this embodiment the tube 30 may be omitted. In this embodiment the base 64 is provided with a central recess 140 which receives and secures the end of the rod 70. The base 64 is provided with a bottom recess 142. A closure plate 144 is pivotally arranged relative to the base 64 on a pivot pin 146 which mounts the plate 144 for rotation relative to the base 64 and which extends into the end of the rod 70 to secure the plate 144 in position. In this embodiment holes 90 and 92 are elongate as shown in FIG. 6.

The end cap 150 may be screw threaded by a screw threaded flange 152 onto the screw threaded neck 18 for transportation purposes and which is adapted to be removed when it is desired to dispense the components from the dispenser 10.

With the end cap 150 is removed a handle 160 (see FIGS. 5 and 6) is engaged with the closure plate 144. A screw 167 holds it on. The handle 160 as is best seen in FIG. 6 has a pin 162 which is received in slot 165 in the closure plate 144. The closure plate 144 includes a pin 163 adapted to slide within slot 165 in the base 64. The handle 160 is then moved in the direction of arrow A with the pin 163 sliding in the slot 165 and with the closure plate 144 rotating about pivot pin 146 in the direction of arrow A so that holes 170 and 172 are brought into registry with openings 90 and passage 92 for allowing the components to selectively pass through the valve arrangement. The pin 163 sliding in the slot 165 limits the extent of rotation to the desired amount.

Force exerted by the rod 70 is transferred to the base 64 by end washer 151 and hence to the neck 18. Thus pressure is not applied to plate 144 which would otherwise tend to make it difficult to open the valve.

The purpose of making the openings 90 and 92 elongate is to ensure that material commences to dispense from both of the openings 172 and 170 at substantially the same time. That is, as the opening 170 begins to overlap with the opening 92 the opening 172 will begin to overlap with the opening 90 so that the components C and C1 in the desired ratio are expelled from the container.

Figures 7, 7A, 8:
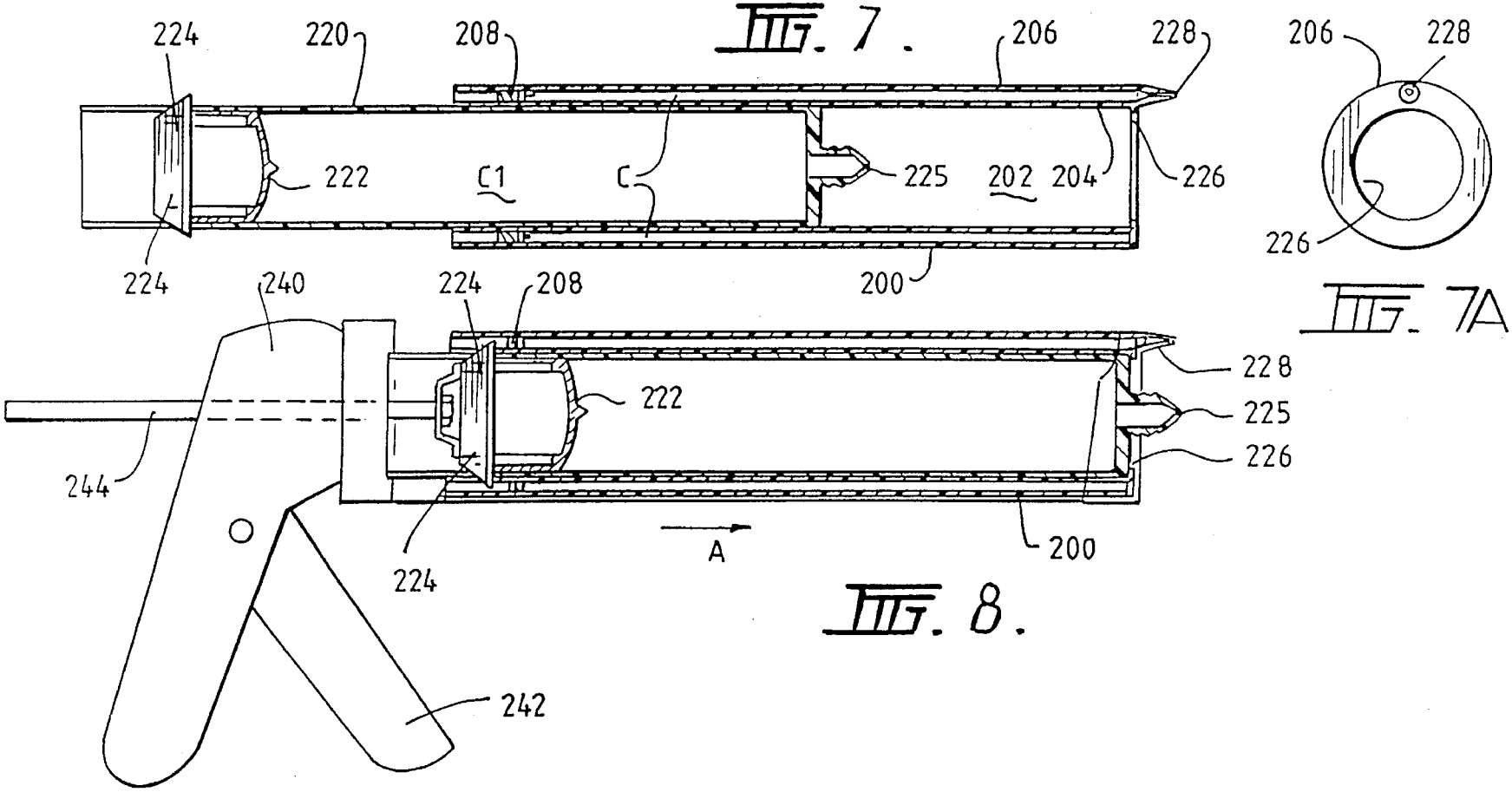
FIG. 7 shows a cross-sectional view of a further embodiment of the invention.
FIG. 8 shows a view of a gun in which the further embodiment of the invention shown in FIG. 7 is used.

A different form of the invention is shown in FIGS. 7 and 8 which generally comprise a hand-held dispenser operated by a gun.

As shown in FIG. 7, a cylindrical container 200 is Provided which has an internal central cavity 202 defined by a cylindrical tubular wall 204. Component C is contained in the space between the cylindrical wall 204 and outer cylindrical wall 206. An annular piston 208 is arranged in the space between the walls 204 and 206.

A cartridge 220 is adapted to be inserted into the cavity 202 and the cartridge 220 has a second piston 222 which has integral blades 224 extending outwardly from it.

When the cartridge 220 is inserted into the cavity 202 an outlet 225 in the cartridge 220 is aligned with outlet 226.

The space containing in the component C has an outlet 228 and when the cartridge 220 is inserted into the cavity 202 the combined container 200 and the cartridge 220 are adapted to be inserted or located in a gun 240. The gun 240 has a trigger 242 and a plunger 244 and is generally conventional in design. The plunger 244 abuts against the piston 222 and application of the trigger 242 will force the plunger 244 forward in the direction of arrow A to push the piston 222 in the direction of arrow A so that component C1 in the cartridge 220 is expelled through opening 226. As the piston 222 moves blades 224 cut through the side wall of the cartridge 220 and also through the cylindrical wall 204 so that the blades 224 abut against the annular piston 208 and push the annular piston 208 in the direction of arrow A so that the piston 208 moves with the piston 222 to dispense component C out of outlet 228. Thus, the components C and C1 are dispensed in the predetermined ratio in view of the simultaneous and fixed relative movement of the pistons 222 and 208 in the same manner as described in the earlier embodiments.

FIGS. 9 to 14 show further embodiments of the invention. In these embodiments of the invention the cartridge 220 is generally the same as the cartridge 220 described in FIGS. 7 and 8 but is of different size as will be apparent from the following description.

In FIG. 9 the container 200 is provided with a relatively narrow bore 274 which is formed in a thickened side wall portion 280 of the container 200. The bore 274 carries a piston 208 and contains the component C. Cartridge 220 is adapted to be inserted into a relatively large cavity 260 in the container 200 and movement of the piston 222 and blade 224 in the cartridge 220 will cut through side wall portion 275 of the thickened side wall 280 and push against piston 208 to expel the component C from the bore 274 as well as the component C1 from the cartridge 220.

In FIG. 10 the container 200 is provided with a pair of side lugs 290. The right hand side lug 290 has a hole 292 which extends all the way through the side lug 290 and the left hand side lug 290 has a hole 294 which extends part way through the lug 290. The cartridge 220 is adapted to be inserted through and supported by right hand side hole 292 and rest in the left hand side hole 294 so as to be attached to the container 200. The cartridge 220 contains the component C and the piston 208 and the container 200 contains the piston 222 with a single blade 224 which cuts through the cartridge 220 and wall of the container 200 as the piston 224 is forced downwardly in the cartridge 220 so that the blade 224 abuts the piston 208 to move the piston 208 simultaneously with the piston 224 to dispense the components C1 and C.

Figure 11A:
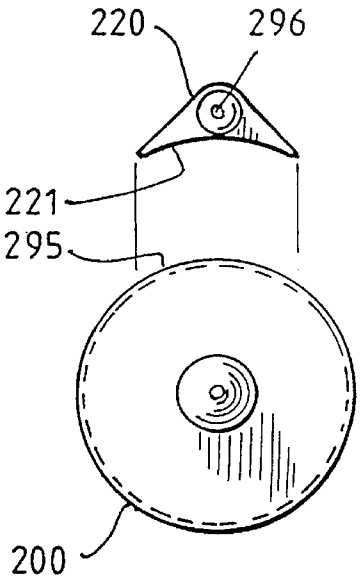
Figure 11:
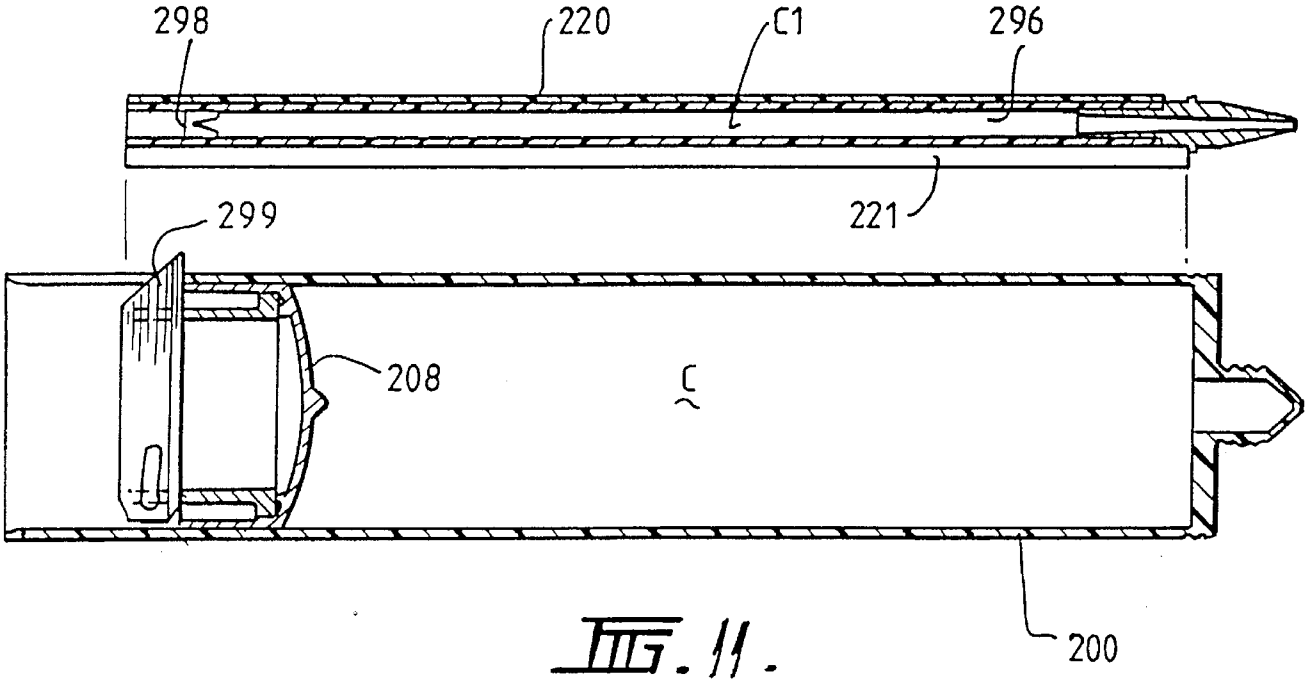

FIG. 11 shows yet a further embodiment in which the container 200 is adapted to receive the cartridge 220 by adhering the cartridge 220 to the container 200. The cylindrical wall portion 295 forms the retainer for the cartridge 220 and may have an adhesive coating which is covered by a peel off strip to expose the adhesive to the cartridge 220. Alternatively, the cartridge 220 could be provided with the adhesive and peel off strip. The cartridge 220 has a concave wall portion 221 which matches the contouring of the cylindrical wall portion 295 so that when the peel off strip is removed the cartridge 220 can be stuck onto the wall 295.

The cartridge 220 includes a bore 296 which contains the component C1 and a piston 298 is arranged in the bore 296. Piston 208 in the container 200 is provided with a blade 299 which extends up beyond the confines of the wall 295 so that as the piston 208 moves it will cut through the wall portion 223 of the cartridge 220 to abut piston 298 and move the piston 298 with movement of the piston 208 so that the components C1 and C are dispensed from the dispenser.

Figure 13:
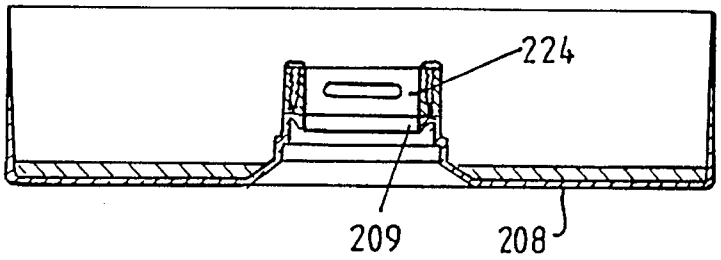
Figure 13:
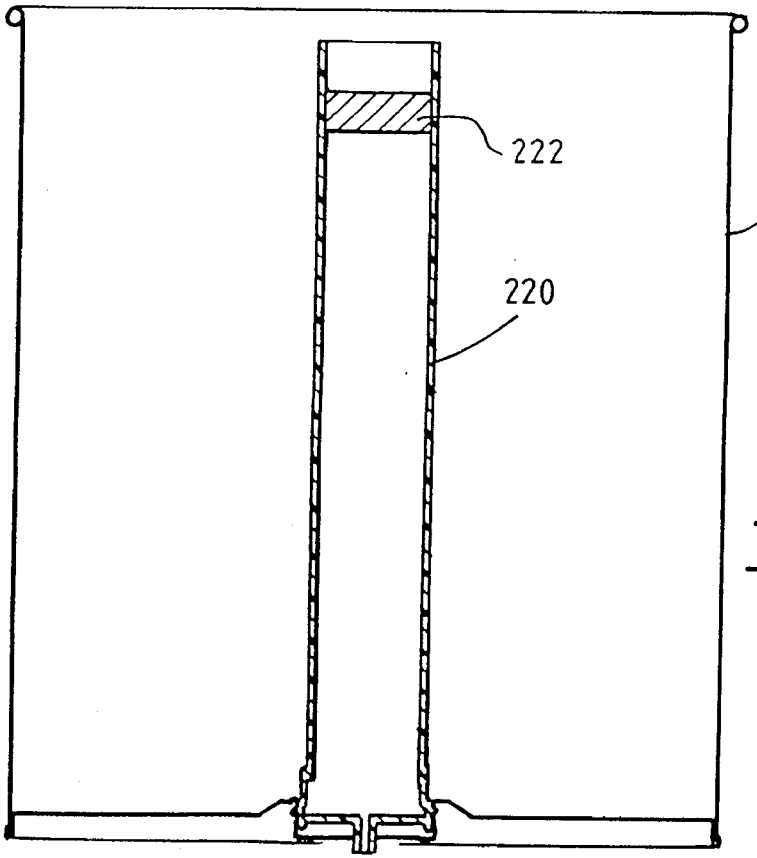
Figure 12:
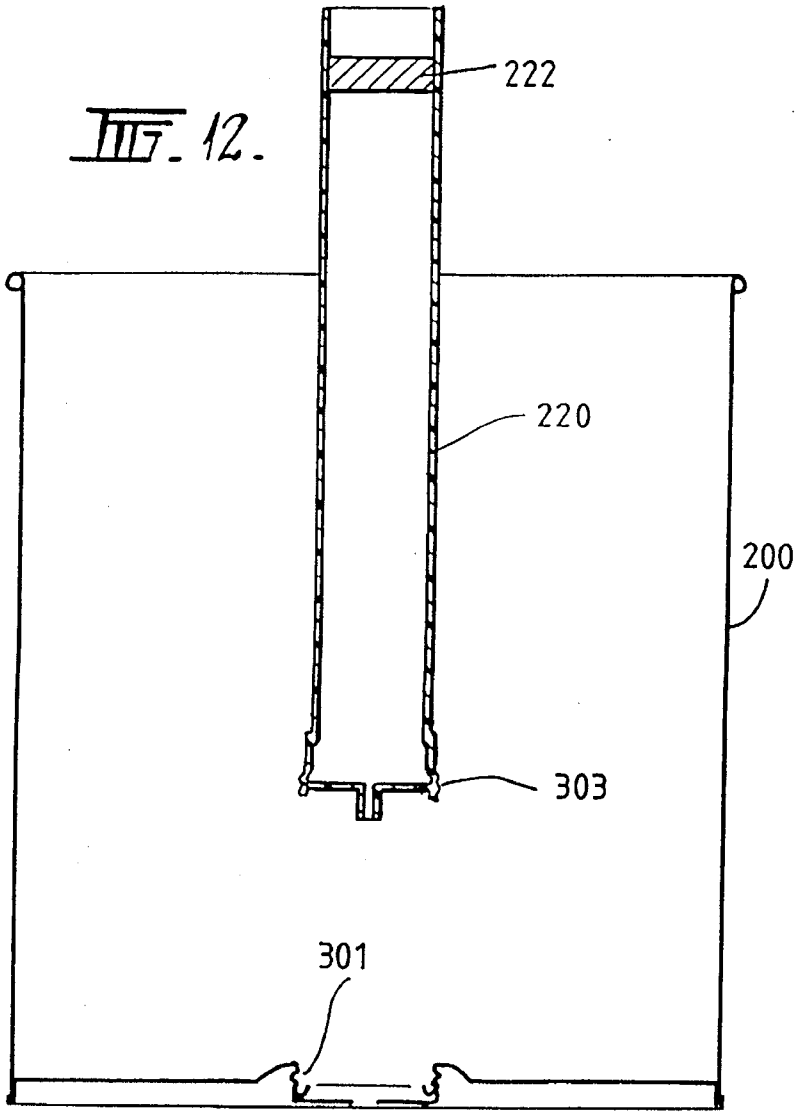

FIGS. 12 and 13 show yet a further embodiment in which the cartridge 220 is coupled to the base 301 of the container 200 by an outlet 303 or the like. Piston 222 is provided in the cartridge 220 and as is shown in FIG. 14 after the cartridge 220 is installed within the container 200 the piston 208 is adapted to be installed into the container 200 with the cartridge 220 penetrating through hole 209 and being cut by blade 224 so that it abuts piston 222 to move the piston 222 in the cartridge 220.

In the embodiment of FIGS. 12 and 13 the cartridge 220 is inserted before the piston 208 is located in the container 200.

Figure 14:
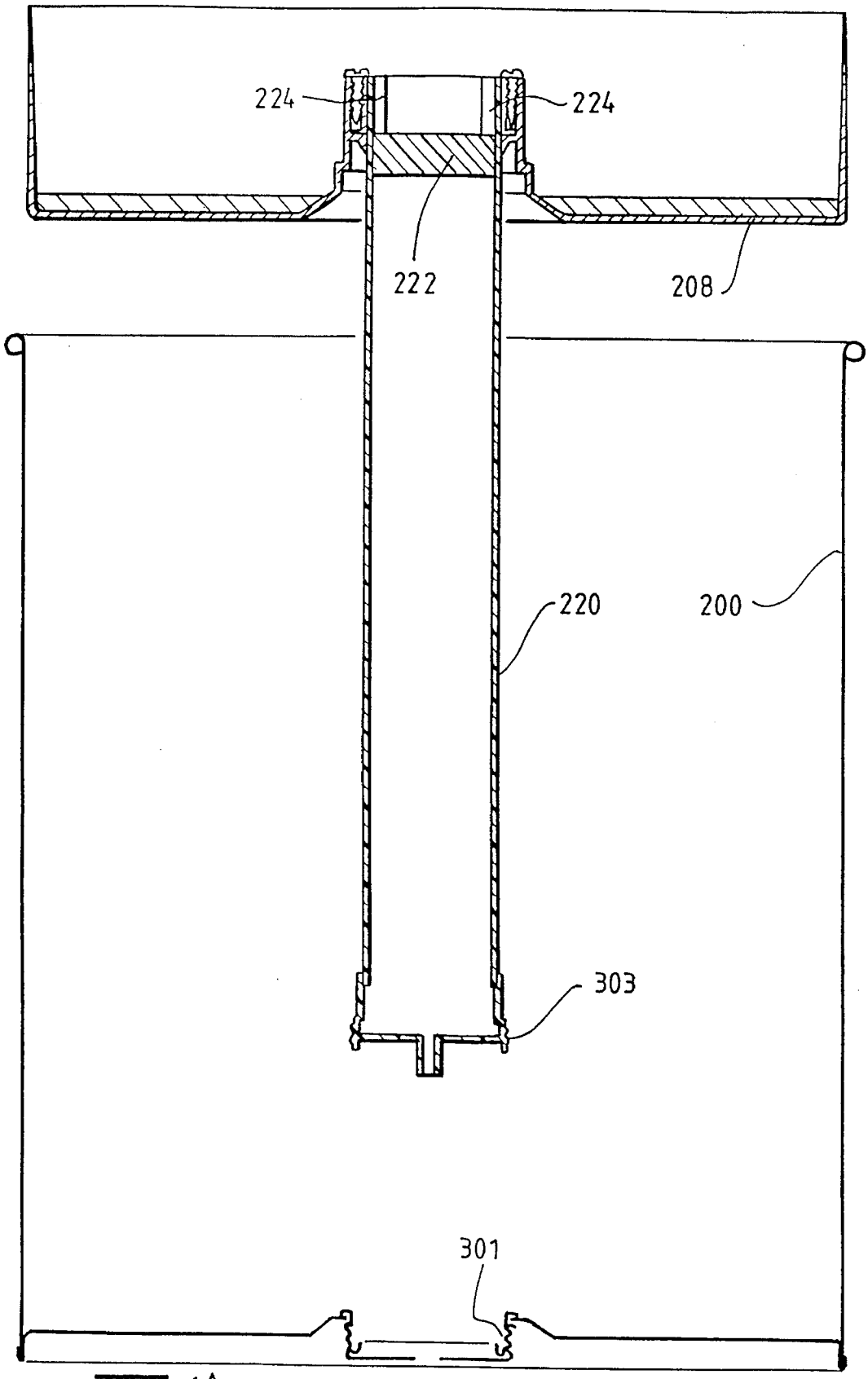

In the embodiment of FIG. 14 the piston 208 is inserted onto the cartridge 220 and the piston 222 abuts the two blade portions 224. The cartridge 220 having the piston 208 thereon is then secured in the container 200 in the same manner as described in FIGS. 12 and 13. When the piston 208 is moved the blades 224 cut the cartridge 220 and also move the piston 222 in view of the connection of the piston 222 with the blades 224.

Figure 15:
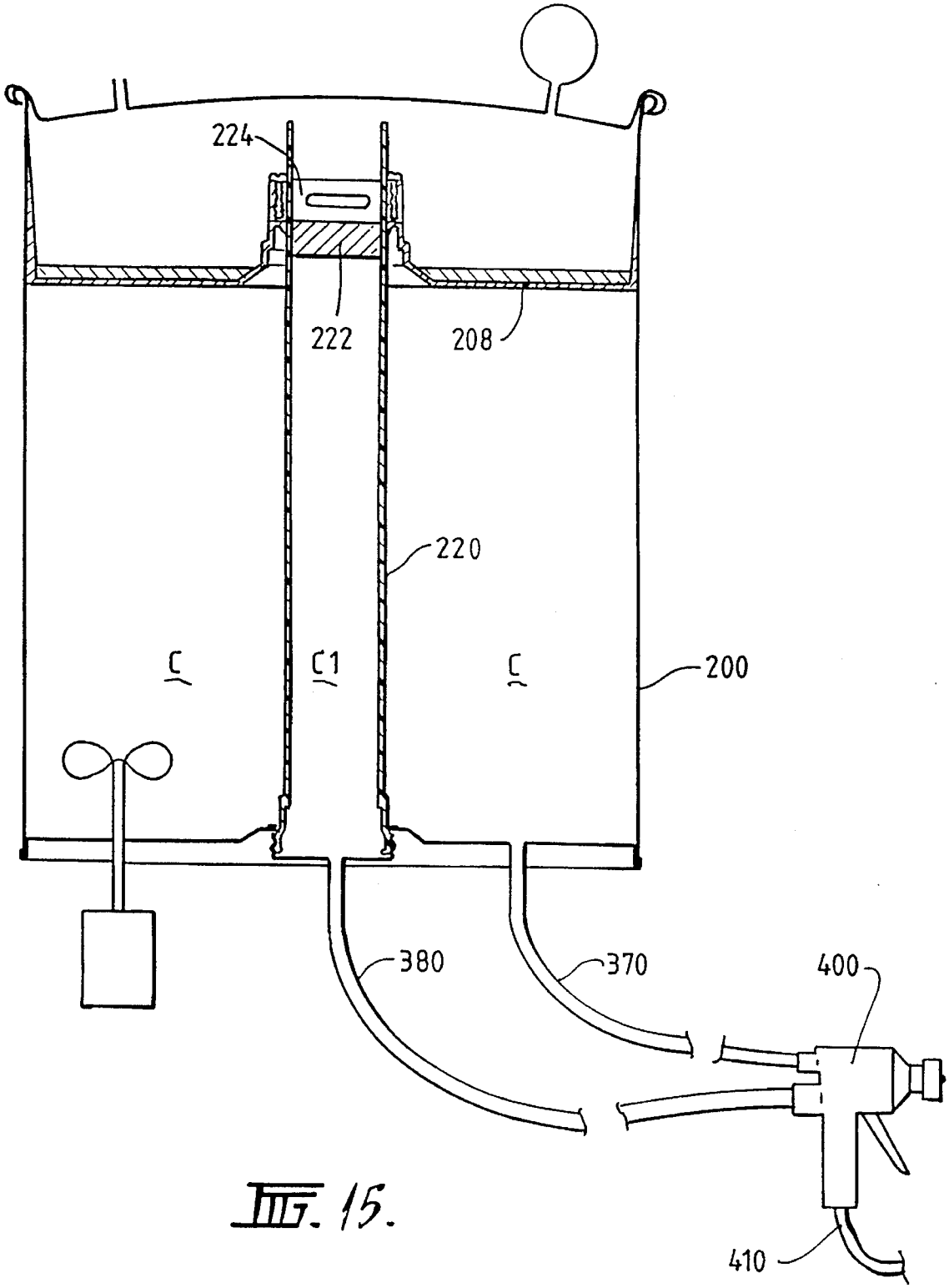
FIG. 15 shows a further application of the invention.

FIG. 15 shows a particular application of the dispenser which is slightly different to the application described with reference to FIG. 1 to 6. In FIG. 16 the dispenser is used with a spray gun 400 for applying two components C and C1 to the spray gun. The components C and C1 could be polyurethane and isocyanate respectively. These components are well known in spray painting and conventionally are mixed together and used immediately. If the mixed components are not used shortly after mixing they harden and are useless. The present invention provides a system where the components C and C1 can be provided from the container 200 and the cartridge 220 through separate conduits 370 and 380 to spray gun 400 for spraying by the spray gun 400 with pressurized air from line 410. Since the components are separated until they are sprayed by spray gun 400 mixing is not necessary and spraying can be stopped and recommenced at any time without fear of the two components mixing and becoming hard.

In the preferred embodiment of the invention the cartridge 60 is preferably formed from stiff or rigid plastics material or the like. However, in other embodiments the cartridge could be in the form of a pouch formed from flexible material or the like.

In another embodiment of the invention (not shown), the first and second pistons could be joined together by the blade so that the first and second pistons and the blade form a unity structure which is inserted into the container and cartridge in a single action.

Since modifications within the spirit and scope of the invention may readily be effected by persons skilled within the art, it is to be understood that this invention is not limited to the particular embodiment described by way of example hereinabove.

The claims defining the invention are as follows:

1. A dispenser cartridge for a dispensing gun which has an actuator for movement in the gun to operate the dispenser cartridge, said dispenser cartridge including:

a first container for containing a first component;

first dispensing means located in the first container, the first dispensing means having a leading face for applying force to the first component to dispense the first component from the first container, the dispensing means being engageable by the actuator of the gun for causing the first dispensing means to dispense the first component from the first container;

a second container, for containing a second component, coupled to the first container and arranged in side-by-side relationship with the first container;

second dispensing means located in the second container, the second dispensing means having a leading face for applying force to the second component to dispense the second component from the second container, the leading face of the first dispensing means being separate from the leading face of the second dispensing means; and drive means, separate from the actuator of the gun, arranged between the first dispensing means and the second dispensing means, and movable when the first dispensing means is engaged by the actuator of the gun, for causing the second dispensing means to dispense the second component from the second container;

the actuator of the gun engaging only the first dispensing means and not the second dispensing means when the dispenser cartridge is located in the gun so that the actuator causes the first dispensing means to dispense the first component and the second dispensing means being operated by the drive means between the first dispensing means and second dispensing means to cause the second dispensing means to dispense the second component from the second container.

2. The dispenser cartridge of claim 1 wherein the drive means comprises a blade for slicing the wall between the first and second containers.

3. The dispenser cartridge of claim 2 wherein the blade is connected to one of the first and second dispensing means and abuts the other of the first and second dispensing means.

4. The dispenser cartridge of claim 1 wherein the drive means and the first and second dispensing means comprises a unitary structure.

5. The dispenser cartridge of claim 2 wherein the blade and the first and second dispensing means comprises a unitary structure.

6. The dispenser cartridge of claim 1 wherein the first and second dispensing means comprises a first piston and a second piston located in the first and second containers respectively, the first piston, in use, being pushed by the actuator of the gun to move the first piston to dispense the first component, and the movement of the first piston causes the drive means to move to, in turn, move the second piston in the second container to dispense the second component from the second container.

7. The dispenser cartridge of claim 1 wherein the drive means is a single element arranged between the first dispensing means and the second dispensing means.

8. The dispenser cartridge of claim 1 wherein the cross-sectional area of the first container is larger than the cross-sectional area of the second container.

* * * * *